United States Patent [19]

Kawaguchi

[11] Patent Number: 4,693,621

[45] Date of Patent: Sep. 15, 1987

[54] PAPER LOADING DEVICE OF PRINTER

[75] Inventor: Katsuhiko Kawaguchi, Nirayama, Japan

[73] Assignee: Tokyo Electric Co., Ltd., Tokyo, Japan

[21] Appl. No.: 891,426

[22] Filed: Aug. 4, 1986

Related U.S. Application Data

[63] Continuation of Ser. No. 695,083, Jan. 25, 1985, abandoned.

[30] Foreign Application Priority Data

Jan. 25, 1984 [JP] Japan ..... 59-11622
Feb. 1, 1984 [JP] Japan ..... 59-16870

[51] Int. Cl.[4] ..... B41J 23/048; B41J 13/20

[52] U.S. Cl. ..... 400/636.1; 400/637.1; 400/639.1

[58] Field of Search ..... 400/636.1, 637, 637.1, 400/637.2, 637.3, 637.4, 637.5, 637.6, 639.1, 639.2

[56] References Cited

U.S. PATENT DOCUMENTS

| | | | |
|---|---|---|---|
| 1,478,380 | 12/1923 | Crawley | 400/637.1 |
| 3,960,258 | 6/1976 | Aebi . | |
| 4,031,995 | 6/1977 | Blum et al. . | |
| 4,486,108 | 12/1984 | Taraka | 400/639.1 |
| 4,525,089 | 6/1985 | Falconieri | 400/639.1 |
| 4,569,611 | 2/1986 | Watanabe et al. | 400/639.1 X |

FOREIGN PATENT DOCUMENTS

| | | | |
|---|---|---|---|
| 126470 | 9/1980 | Japan | 400/637.1 |
| 58-31312 | 7/1983 | Japan . | |

*Primary Examiner*—Charles A. Pearson
*Attorney, Agent, or Firm*—Oblon, Fisher, Spivak, McClelland, & Maier

[57] ABSTRACT

The invention provides a paper loading device for a printer wherein, when paper is to be loaded onto a platen, in response to operation of a button or a lever with paper set in position, the platen is driven to cause the paper to be loaded thereto, and upon such loading of the paper, a paper bail roller is automatically moved away from the platen. After loading of the paper, the paper bail roller is returned to a position adjacent the platen.

3 Claims, 11 Drawing Figures

PAPER LOADING DEVICE OF PRINTER

This application is a continuation, of application Ser. No. 695,083, filed Jan. 25, 1985, now abandoned.

FIELD OF THE INVENTION

This invention relates to a paper loading device for a printer wherein a platen is rotated to feed paper wrapped therearound.

DISCUSSION OF BACKGROUND

A prior art paper feeding device utilizes paper being held between a platen and a pinch roller which is guided by a paper bail roller in a direction to be discharged from the platen. In a paper feeding means of this prior art type, when paper is manually inserted between the platen and a printing station, a paper bail roller must be manually moved towards and away from the platen. This is a troublesome operation particularly when cut-sheet paper is used and the paper bail roller must be manually moved from the platen and to the platen for each paper sheet.

SUMMARY OF THE INVENTION

It is a first object of the present invention to provide a paper loading device wherein paper can be easily wrapped around a platen.

It is a second object of the invention to provide a paper loading device wherein a paper bail roller is moved away from a platen to facilitate passage of paper upon loading of the paper.

It is a third object of the invention to provide a paper loading device which is electromagnetically driven to have paper automatically loaded thereto.

It is a fourth object of the invention to provide a paper loading device wherein a paper bail roller is moved away from a platen in simultaneous relationship as a pinch roller is moved away from the platen.

It is a fifth object of the invention to provide a paper loading device wherein a platen can be rendered operative even manually for loading of paper.

Other objects of the invention will become apparent from the following description.

BRIEF DESCRIPTION OF THE DRAWINGS

FIG. 11 is a similar side elevational view showing the paper bail arm further spaced away from the platen to turn a paper feed switch on.

DETAILED DESCRIPTION OF THE PREFERRED EMBODIMENTS

Figure 1:
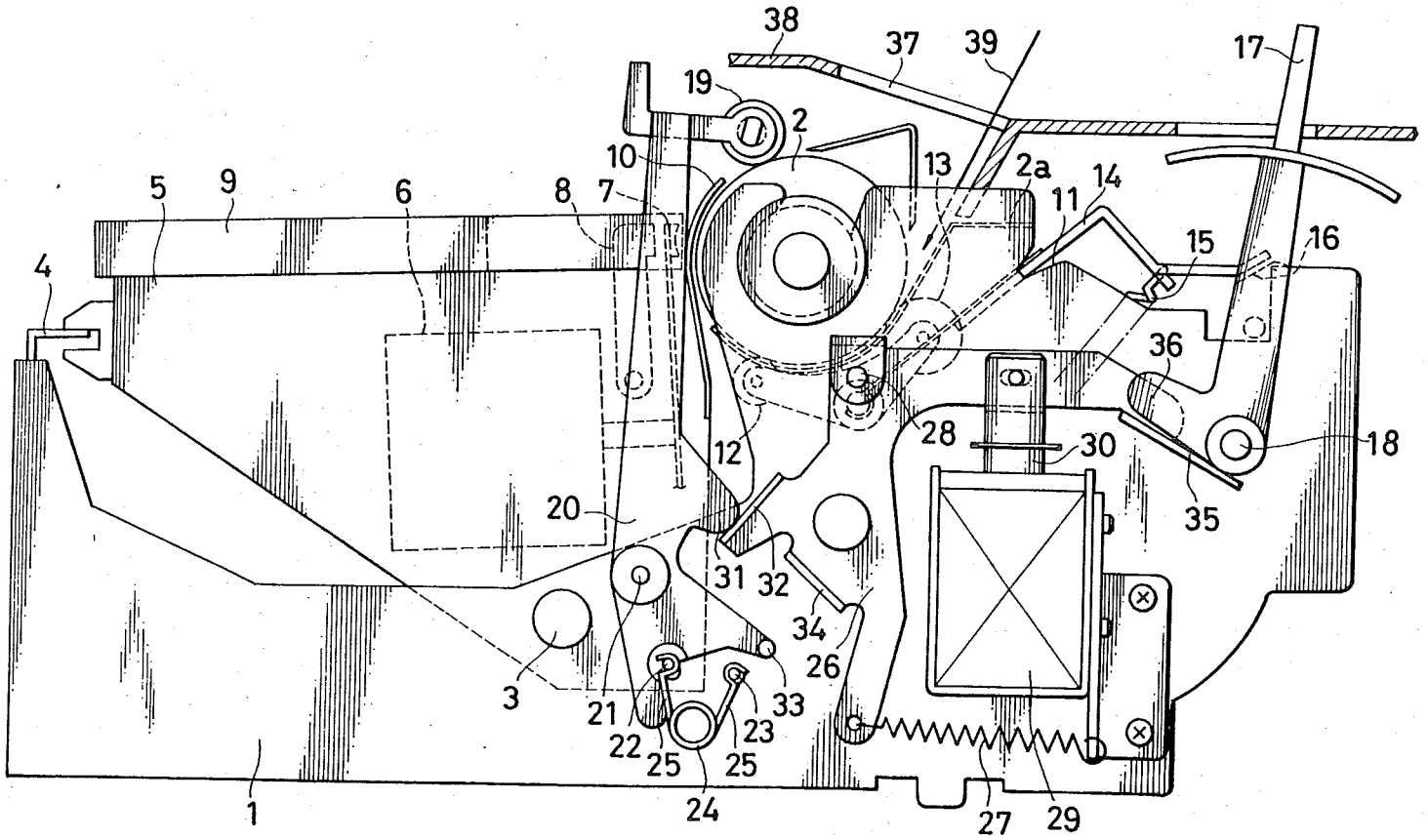
FIG. 1 is a side elevational view of a first embodiment of the present invention showing a platen contacted by a pinch roller and a paper bail roller.

A first embodiment of the present invention will be described with reference to FIGS. 1 to 8. A platen 2 extends between and is supported for rotation on a pair of opposing side walls 1, and a paper pan 2*a*, a carrier shaft 3 and a guide 4 are located between the side walls 1. A carrier 5 is mounted for sliding movement on the carrier shaft 3 and the guide 4. A wheel motor 6 and a print wheel 7 connected thereto are mounted on the carrier 5, and a print hammer 8 connected to a solenoid (not shown) is also mounted for pivotal motion on the carrier 5. A ribbon cassette 9 is removably mounted on the carrier 5, and a guide plate 10 curved in an arc complementary to the platen 2 is also mounted on the carrier 5.

Each of the side walls 1 has a recess 11 formed therein, and a pinch roller support plate 14 on which pinch rollers 12 and 13 are supported is supported at opposite ends thereof in the recesses 11 of the side walls 1 and is urged in a clockwise direction by a spring 15. A manipulating lever 17 is mounted for rotation on one of the side walls 1 by means of a pivot 18 and has an abutting face 16 which is opposed to a rear end of the pinch roller support plate 14. A pair of paper bail arms 20 on which a paper bail roller 19 is supported are mounted for pivotal motion on the left and right side walls 1 by means of pivots 21. Opposite hooks 25 of toggle springs 24 are hooked to pins 22 mounted on the paper bail arms 22 and pins 23 mounted on the corresponding side walls 1.

An operating member 26 is mounted for pivotal motion around a pivot 28 on the one side wall 1 and is urged in a counterclockwise direction by a spring 27. The operating member 26 is connected to a plunger 30 of a solenoid 29 as an electromagnet secured to the side wall 1 and has formed thereon a pressing portion 32 for pressing against a projection 31 of one of the paper bail arms 20 and a stopper 34 for supporting a pin 33 mounted on the one paper bail arm 20. Meanwhile, the manipulating lever 17 has formed thereon a second pressing portion 36 for pressing against a bent lug 35 formed at a rear portion of the operating member 28. A cover 38 having an opening 37 formed therein is located above the platen 2.

Figure 5:
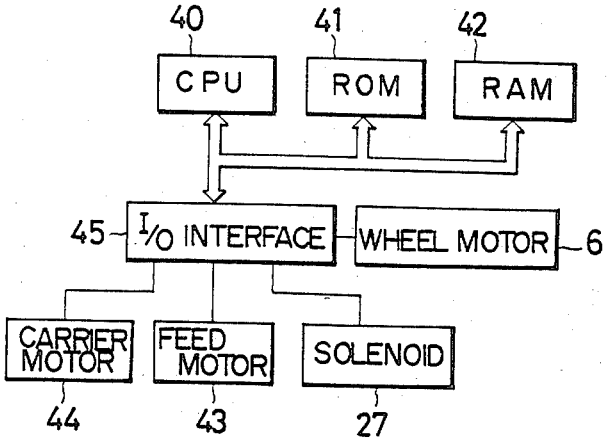
FIG. 5 is a block diagram.
Figure 7:
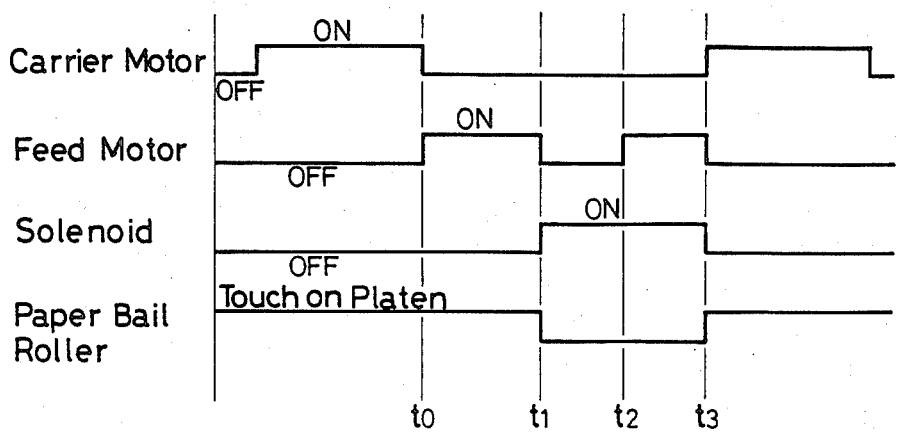
FIGS. 7 and 8 are timing charts.
Figure 8:
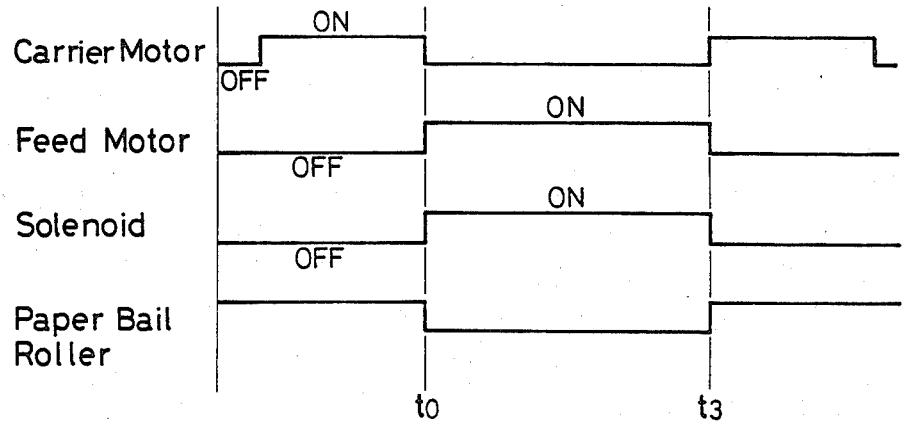

Further, as shown in FIG. 5, a ROM 41 and a RAM 42 are connected to a CPU 40, and the wheel motor 6, the solenoid 29, a feed motor 43 coupled to the platen 2, and besides a carrier motor 44 for driving the carrier 5 are connected to the CPU 40 via an I/O interface 45.

Figure 2:
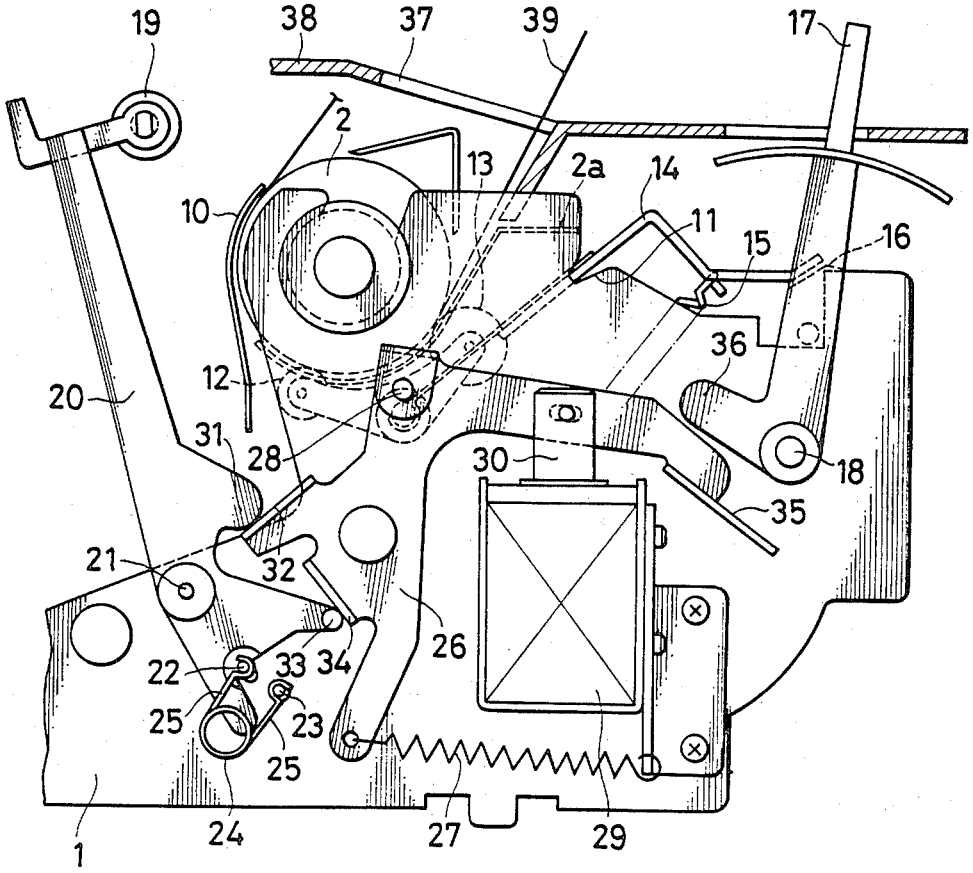
FIG. 2 is a similar but partial side elevational view showing the paper bail roller spaced from the platen by means of a solenoid.
Figure 3:
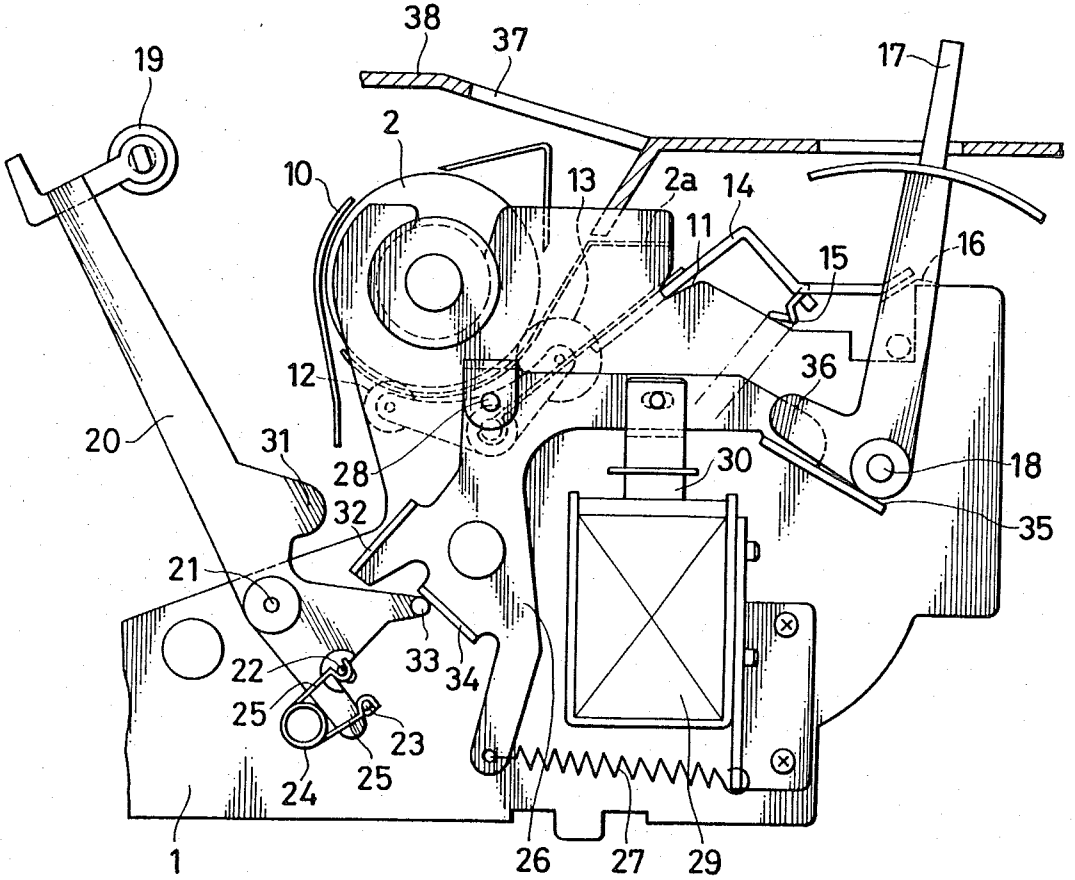
FIG. 3 is a similar side elevational view showing the paper bail roller manually spaced from the platen.
Figure 6:
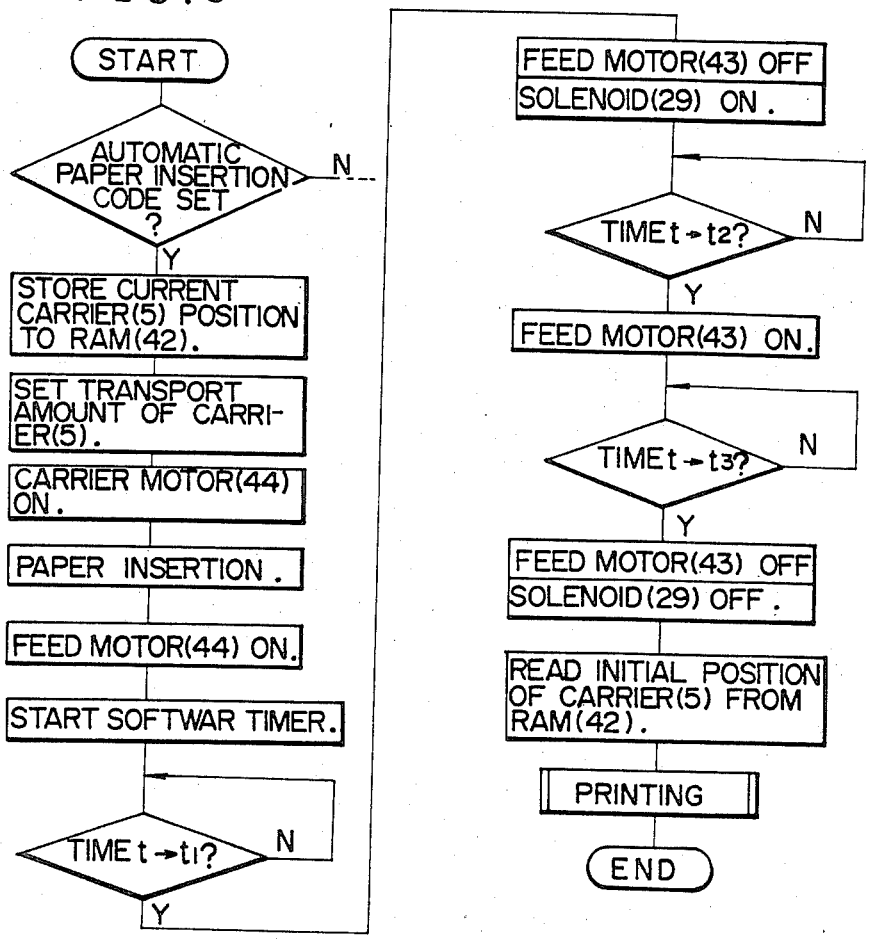
FIG. 6 is a flowchart.

In this construction, in response to operation of a key on the cover 38, it is judged, as shown in the flowchart of FIG. 6, if an automatic paper insertion code is set. If an answer is yes, then a current position of the carrier 5 is stored into a work area of the RAM 42, and an amount or distance over which the carrier 5 is to travel is set in accordance with a difference between the current position of the carrier 5 and the center position along the platen 2. Then, the carrier motor 44 is rotated forwardly or reversely to move the carrier 5 to a position opposing the center of the platen 2. Then when paper 39 is put between the platen 2 and the paper pan 2*a* through the opening 37 of the cover 38, the feed motor 43 is turned on to rotate the platen 2 to feed the paper 39. Simultaneously a soft timer starts its operation. Where the starting point of time is designated t0, the feed motor 43 is turned off and the solenoid 29 is turned on after a time t1 has passed. As a result, the plunger 30 is retracted from the position as shown in FIG. 1 to a position as shown in FIG. 2 so that the operating member 26 is pivoted in the clockwise direction about the pivot 28 against the urging of the spring 27 to push, at the pressing portion 32 thereof, the paper bail arm 20 away from the platen 2. However, the paper bail arm 20 is stopped at a position just forwardly of a neutral position by the stopper 34 of the operating member 26 abutting with the pin 33 on the paper bail arm 20. The toggle spring 24 has a tendency to develop or expand the hooks 25 thereof from each other, and in the position of FIG. 2, the pin 22 is positioned below a straight line linking the pivot 21 and the pin 33 so that the toggle spring 24 urges the paper bail arm 20 to the platen 2, that is, in the clockwise direction. Referring back to FIG. 6, when the time t of the soft timer reaches t2, the feed motor 43 is turned on so that the paper 39 inserted between the platen 2 and the paper pan 2*a* is fed, under the guidance of the guide plate 10 of the carrier 5, by the platen 2 rotated by the motor 43 and cooperating with the pinch rollers 12 and 13. When the time t of the soft timer reaches t3, the feed motor 43 is turned off to end the automatic insertion or loading of the paper 39 and the solenoid 29 is turned off to allow the plunger 29 to move up so that the operating member 26 is returned in the counterclockwise direction by the force of the spring 27. As a result, the paper bail arm 20 which has been held stopped at the position just forwardly of the neutral position as shown in FIG. 2 is now pivoted in the clockwise direction by the force of the toggle spring 24 to a position in which paper bail roller 29 holds down the paper 39 on the platen 2. After the paper 39 has been set in position, the initial position of the carrier 5 is read from the RAM 42 to allow subsequent ordinary printing operations in accordance with a program of the ROM 41.

Accordingly, an operator can, at the beginning of printing operation, automatically load paper 39 only by operation of a key. Thus, when the paper 39 is inserted between the paper bail roller 19 and the platen 2 while the paper bail roller 19 is held spaced away from the platen 2 by energization of the solenoid 29 and then the solenoid 29 is deenergized to allow the operating member 26 to be returned to its initial position, the paper bail arm 20 is pivoted to the platen 2 by the force of the toggle spring 24 to automatically hold the platen 2 with the paper bail roller 29 so that the paper 39 can be introduced with certainty into the opening 37 of the cover 38 without being caught by a lower face of the cover 38. This is because, in FIG. 2, the stopper 34 holds the paper bail arm 20 to the position just forwardly of the neutral position and hence the paper bail arm 20 is held urged in the clockwise direction by a force, though weak, of the toggle spring 24. Further, while, in inserting the paper 39, the feed motor 43 is energized for a period of time from t0 to t1 of FIG. 7 and at the time t1 the solenoid 29 is turned on to move the paper bail roller 19 away from the platen 2 whereafter the feed motor 43 is energized again for a period of time from t2 to t3 to insert the paper 39, the feed motor 43 and the solenoid 29 may otherwise be energized for a period of time from t1 to t3 to insert the paper 39.

Meawhile, the solenoid 29 is not energized before operation of the key for initiation of printing, and if in this condition the paper bail arm 20 is manually moved away from the platen 2, the paper bail arm 20 will be moved to a position a little beyond the neutral position and thereafter held thereto under an urging force of the toggle spring 24 acting in the counterclockwise direction. Thus, if the key is operated for initiation of printing, the solenoid will be energized for the period of time from t1 to t3 or from t0 to t3 as described hereinabove to pivot the operating member 26 in the clockwise direction so that the stopper 34 will press against the pin 33 to move the paper bail arm 20 to the position a little displaced toward the platen 2 from the neutral position as seen in FIG. 2. Accordingly, even when the paper bail arm 20 is manually moved far away from the platen 2, if the solenoid 29 is turned off at the time t3 after insertion of the paper 39, the paper bail roller 19 can be contacted with the platen 2 without fail, thereby preventing the paper 39 from being caught by the lower face of the cover 38.

Figure 4:
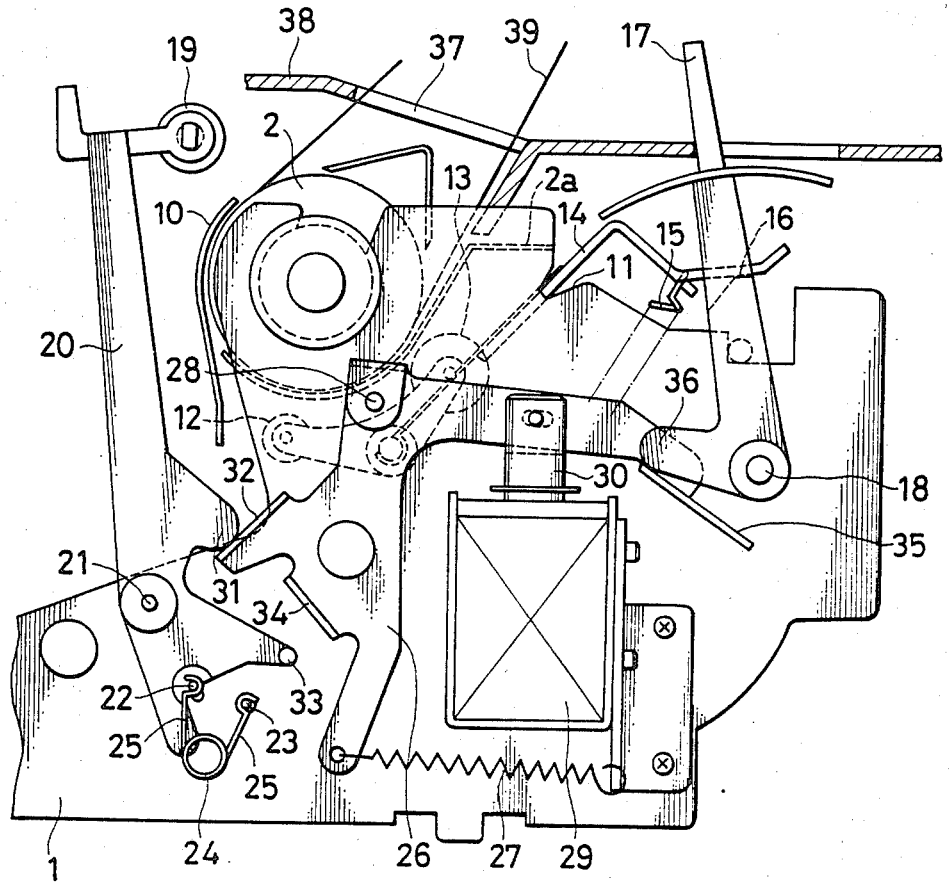
FIG. 4 is a similar side elevational view showing the pinch roller and the paper bail roller both manually spaced away from the platen.

Further, referring to FIG. 4, if the manipulating lever 17 is pushed leftwardly, the abutting face 16 thereof pushes up the pinch roller support plate 14 so that the pinch rollers 12 and 13 are moved away from the platen 2. In the meantime, the operating member 26 is pivoted in the clockwise direction by the pressing portion 36 of the manipulating lever 17 to push down the plunger 30 and to push, at the pressing portion 32 thereof, the paper bail arm 20 away from the platen 2. In this case, the paper bail arm 20 does not move beyond the neutral position thereof and is stopped and held to a position in which it is urged in the clockwise direction by the toggle spring 24. Accordingly, if the manipulating lever 17 is returned rightwardly to its initial position, the pinch roller support plate 14 is pivoted in the clockwise direction around the recess 11 by the urging of the spring 15 to move the pinch rollers 12 and 13 towards the platen 2 while simultaneously the operating member 26 is returned to its initial position by the urging force of the spring 27 and the paper bail arm 20 is returned to the position adjacent the platen 2 by the force of the toggle spring 24. Since the paper bail roller 19 can be moved from and to the platen 2 in response to operations to move the pinch rollers 12 and 13 from and to the platen 2, a paper loading or inserting operation is very simple. This is very convenient when the pinch rollers 12 and 13 and the paper bail roller 19 are moved away from the platen 2 to make the paper 39 free.

A second embodiment of the present invention will now be described with reference to FIGS. 9 to 11. Bearings 53 for rotatably supporting opposite ends of a platen 52 are held on a pair of opposing side frames 51. A paper pan 54 is located in opposing relationship below the platen 52 while a top cover 56 having a window 55 formed therein is located above the platen 52. The side frames 51 have recesses 58 formed therein for supporting a plate 57 for pivotal motion therein. A spring plate 61 is mounted on the plate 57 and resiliently supports thereon a pinch roller arm 60 from below on which a pinch roller 59 is mounted. The plate 57 is urged in a clockwise direction about the recesses 58 by a spring 62.

A pair of paper bail arms 63 are mounted for rotation about pins 64 on the side frames 51 and support thereon a shaft 65 on which a paper bail roller 66 is fitted. A pair of toggle spring 68 are provided for the side frames 51, and each of the toggle springs 68 has a leg 67 held on one of the side frames 51 and another leg 69 held by the corresponding one of the paper bail arms 63. The toggle springs 68 have a tendency to develop or expand the legs 67 and 69 thereof outwardly from each other and hence the paper bail arms 63 are normally urged toward the platen 52 by the toggle springs 68. But if the paper bail arms 63 are moved away from the platen 52 and beyond a neutral position thereof, now they are urged reversely in a direction to move away from the platen 52 by the toggle springs 68. One of the side frames 51 has mounted thereon a paper feed switch 71 having an actuator 70 thereof urged to its off position in an upward direction and a spring plate 72 which serves as an abutment for the paper feed switch 71. A corresponding one of the paper bail arms 63 has integrally formed thereon a switching portion 73 located in opposing relationship to the actuator 70, a projection 74 located in opposing relationship to the spring plate 72, and a handle 75 extending upwardly.

In this construction, when paper 77 is to be inserted or loaded, a carrier (not shown) is positioned substantially at the center along the platen 52 so as to oppose a paper guide mounted on the carrier to an outer periphery of a central portion of the platen 52. Then the handle 75 is pivoted to move the paper bail arms 63 away from the plate 52 as shown in FIG. 10, and paper 77 is inserted between the outer periphery of the plate 52 and the paper pan 54 through the opening 55 of the top cover 56. The toggle springs 68 urge the paper bail arms 63 away from the platen 52 if the paper bail arms 63 are moved beyond the neutral position thereof, but in a position as shown in FIG. 10, the spring plate 72 holds the paper bail arms 63 substantially to the neutral position thereof against the urging of the toggle springs 68, preventing the switching portion 73 of the one paper bail arm 63 from contacting with the actuator 70 of the paper feed switch 71. If the paper bail arms 63 are moved further away from the platen 52 against the urging of the spring plate 72 as shown in FIG. 11 after the paper 77 has been inserted through the window 55 of the top cover 56, the switching portion 73 of the paper bail lever 63 will push the actuator 70 to turn the paper feed switch 71 on. As a result, a motor (not shown) connected to the platen 52 is now connected to a power source so that the paper 77 is inserted inside the paper guide 76 by the platen 52 and the pinch roller 59. If the operating force is removed, the paper bail arms 63 are returned to a position adjacent the neutral position thereof as shown in FIG. 10 by the urging of the spring plates 72 and hence the actuator 70 of the paper feed switch 70 is released from the paper bail arm 63. In the present embodiment, the motor is energized in response to a single switching operation of the paper feed motor 71 and is kept energized for a period of time determined by a timer in order that paper 77 may be fed by a predetermined fixed distance independently of a period of time in which the actuator 70 of the paper feed motor 71 is held depressed. But it is also possible to omit the timer so as to rotate the platen 52 while the actuator 70 is held depressed.

Figure 9:
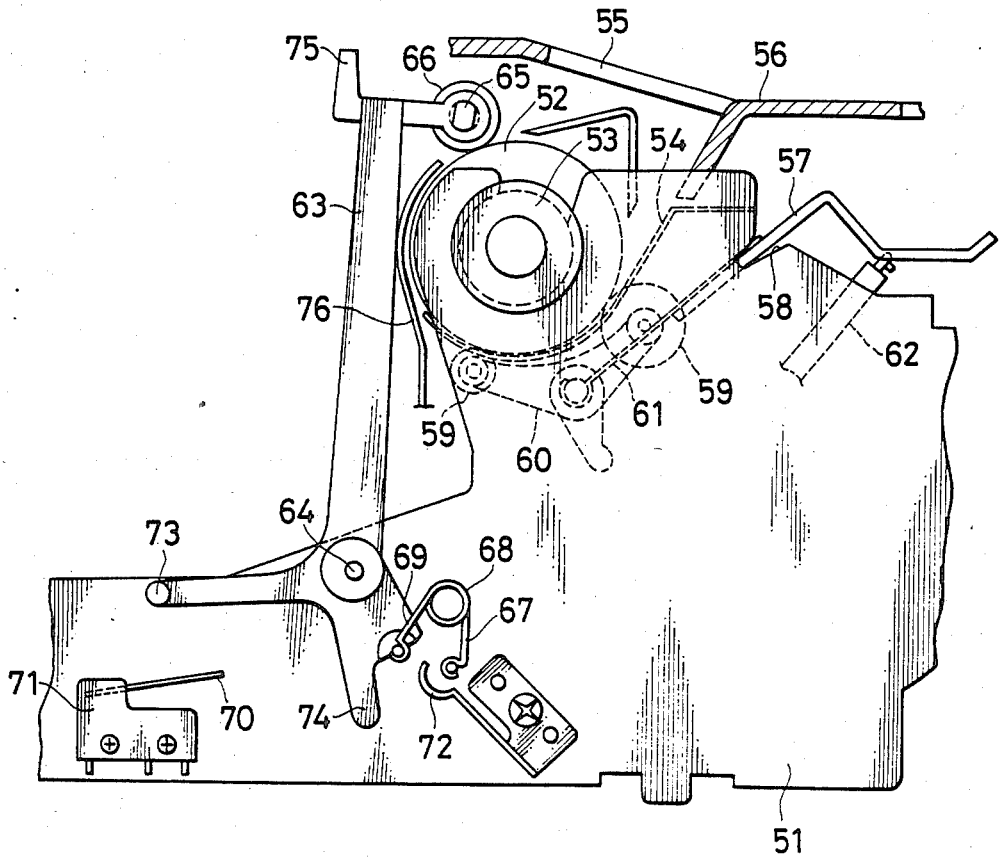
FIG. 9 is a side elevational view of a second embodiment of the invention showing a paper bail roller contacted with a platen.

After insertion of the paper 77 in this manner, the paper bail arms 63 will be pivoted toward the platen 52 as shown in FIG. 9 until the paper bail roller 66 is contacted under pressure with the platen 2 by the urging of the toggle springs 68. In this position, the paper feed switch 71 is held off, but the motor for driving the platen 52 may otherwise be driven under control of a known controlling circuit in response to a paper feed signal produced in connection with an ordinary printing operation.

Figure 10:
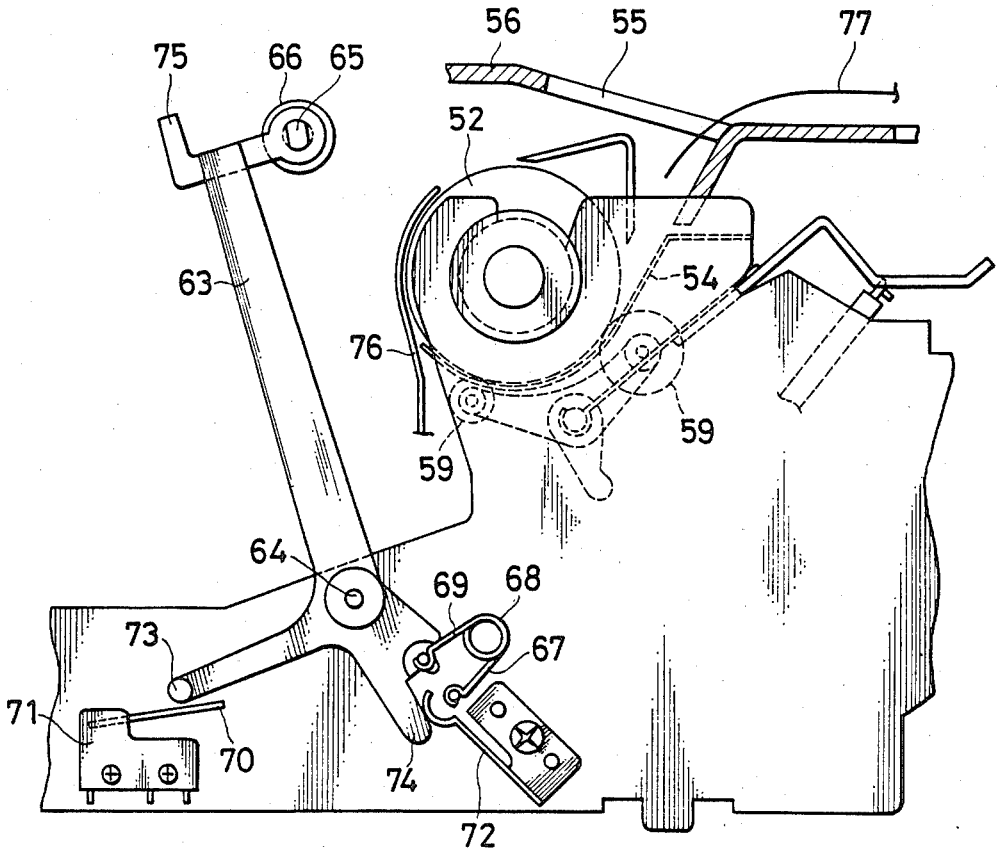
FIG. 10 is a similar side elevational view showing a paper bail arm spaced away from the platen.
Figure 11:
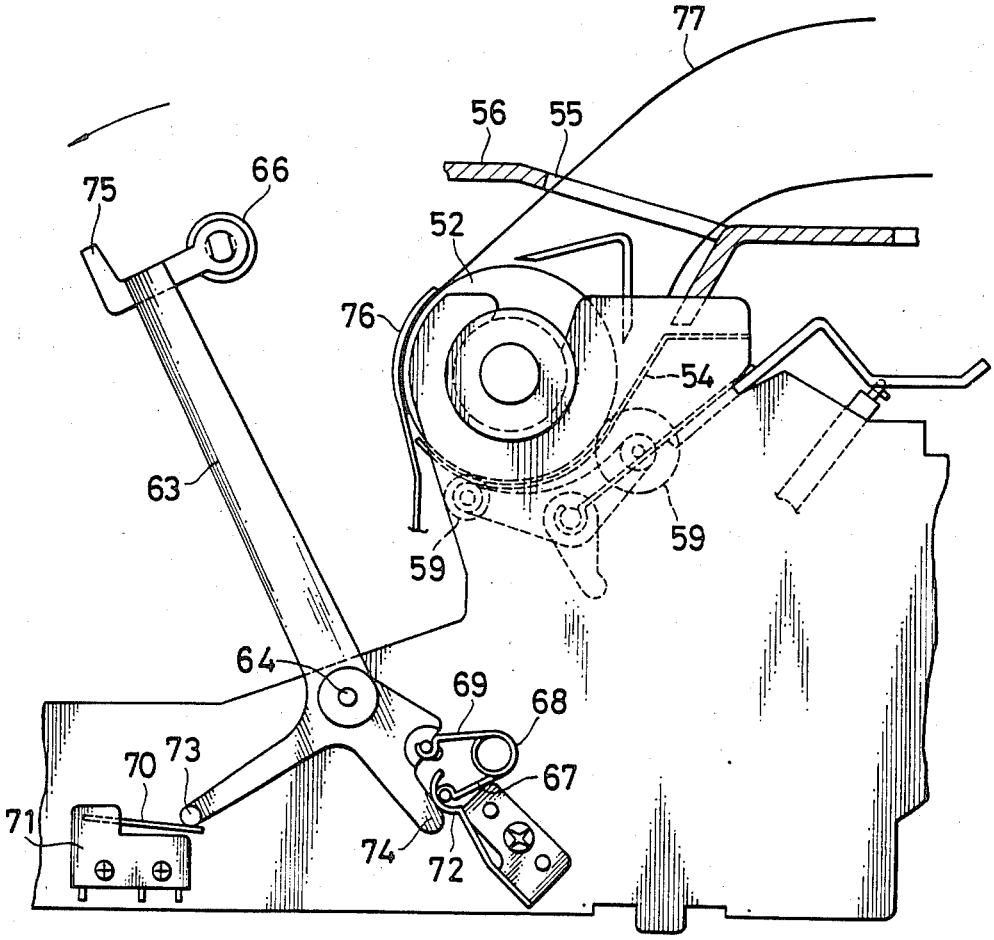

It is to be noted that while the paper bail arms 63 are held to the intermediate position by the spring plate 72 against the urging of the toggle springs 68 as shown in FIG. 10 to keep the paper feed switch 71 off, it is also possible to otherwise make the force to urge the actuator 70 upwardly greater than the force of the toggle springs 68 so that the actuator 70 may act a support instead of the spring plate 72. Or otherwise, a support of the paper bail arms 60 may be provided by an element which applies a lateral pressure to the paper bail arm 63 at the intermediate position whereby the paper bail arms 63 can be stopped at the intermediate position due to the lateral pressure.

The invention claimed is:

1. An automatic loading device for a printer, comprising:

a platen connected to be rotated by a feed motor to feed paper;

a pinch roller mounted for movement toward and away from said platen;

a manipulating lever for manually positioning said pinch roller;

a pair of left and right paper bail arms mounting a paper bail roller for rotation in opposing relationship to said platen and wherein said paper bail arms include means for pivotal motion to move said paper bail roller toward and away from said platen;

a toggle spring for urging said paper bail arms toward and away from said platen on opposite sides of a neutral position of said paper bail arms;

an operating member having a pressing portion for pressing said paper bail arms away from said platen and a stopper, separate from said pressing portion, for supporting said paper bail arms at a position just on the platen side of said neutral position when said paper bail arms are pressed by said pressing portion of said operating member;

an electromagnetic actuating means for displacing said operating member to press against said paper bail arms to move said paper bail roller away from said platen whereby said device automatically feeds paper without any need for manual movement of said paper bail arm; and said stopper serving as a means for stopping said paper bail arms at a second position on the opposite side of said neutral position from the platen side, said paper bail arms being urged toward and maintained in said second position by said toggle spring when said paper bail arms are manually operated to move said paper bail roller away from said platen.

2. A paper loading device for a printer according to claim 1, including means for returning said paper bail arms to said position just on the platen side of said neutral position from said second position upon displacement of said operating member by said electromagnetic actuating means.

3. An automatic paper loading device for a printer, comprising:

a platen connected to be rotated by a feed motor to feed paper;

a pinch roller mounted for movement toward and away from said platen;

a manipulating lever having a first abutment for manually positioning said pinch roller;

a pair of left and right paper bail arms mounting a paper bail roller for rotating in opposing relationship to said platen and wherein said paper bail arm include means for pivotal motion to move said paper bail roller toward and away from said platen;

a toggle spring for urging said paper bail arms toward and away from said platen on opposite sides of neutral position of said paper bail arms;

an operating member having a pressing portion for pressing said paper bail arms away from said platen and a stopper, separate from said pressing portion, for supporting said paper bail arms at a position just on the platen side of said neutral position when said paper bail arms are pressed by said pressing portion of said operating member;

an electromagnetic actuating means for displacing said operating member to press against said paper bail arms to move said paper bail roller away from said platen; and a second abutment formed on said manipulating lever for pressing said operating member to move said paper bail roller away from said platen when said manipulating lever is pivoted to move said pinch roller away from said platen.

* * * * *